United States Patent [19]

Shirley

[11] Patent Number: 4,700,790

[45] Date of Patent: Oct. 20, 1987

[54] ROTARY DRILL BITS

[75] Inventor: David Shirley, Cheltenham, England

[73] Assignee: NL Petroleum Products Limited, Gloucestershire, England

[21] Appl. No.: 706,060

[22] Filed: Feb. 26, 1985

[30] Foreign Application Priority Data

Feb. 28, 1984 [GB] United Kingdom ..... 8405180

[51] Int. Cl.[4] ..... E21B 10/58

[52] U.S. Cl. ..... 175/410; 29/453; 29/525; 175/409

[58] Field of Search ..... 175/410, 409, 373, 374, 175/329; 76/108 A; 29/450, 451, 525, 523, 453

[56] References Cited

U.S. PATENT DOCUMENTS

| | | | |
|---|---|---|---|
| 3,375,670 | 4/1968 | Serota | 29/523 X |
| 3,618,683 | 11/1971 | Hughes | 175/410 |
| 3,693,736 | 9/1972 | Gardner | 175/410 |
| 4,014,395 | 3/1977 | Pearson | 175/410 |
| 4,151,889 | 5/1979 | Lister | 175/410 |
| 4,453,605 | 6/1984 | Short, Jr. | 76/108 A X |

FOREIGN PATENT DOCUMENTS

| | | | |
|---|---|---|---|
| 582399 | 11/1977 | U.S.S.R. | 175/410 |
| 1033691 | 8/1983 | U.S.S.R. | 175/410 |

*Primary Examiner*—Stephen J. Novosad
*Assistant Examiner*—David J. Bagnell
*Attorney, Agent, or Firm*—Browning, Bushman, Zamecki & Anderson

[57] ABSTRACT

A rotary drill bit for use in drilling or coring deep holes in subsurface formations comprises a bit body having a shank for connection to a drill string, a plurality of cutting elements mounted at the surface of the bit body, and a passage in the bit body for supplying drilling fluid to the surface of the bit body. At least some of the cutting elements are each mounted on a stud which is received in a socket in the bit body, there being provided within the socket and disposed around at least a portion of the periphery of the stud resiliently compressible retaining means, such as a corrugated sleeve, which is formed separately from the stud and bit body and is resiliently compressed between the stud and the wall of the socket so as frictionally to retain the carrier in the socket.

9 Claims, 5 Drawing Figures

ROTARY DRILL BITS

BACKGROUND OF THE INVENTION

The invention relates to rotary drill bits for use in drilling or coring deep holes in subsurface formations and, in particular, to arrangements for mounting cutting members in such bits.

Rotary drill bits of the kind to which the invention relates comprise a bit body having a shank for connection to a drill string and an inner passage for supplying drilling fluid to the face of the bit. The bit body carries a plurality of cutting elements. Each cutting element may comprise a circular preform having a thin hard facing layer, which defines the front cutting face of the element, bonded to a less hard backing layer. For example, the hard facing layer may be formed of polycrystalline diamond or other superhard material, and the backing layer may be formed of cemented tungsten carbide. The two-layer arrangement of the cutting elements provides a degree of self-sharpening since, in use, the less hard backing layer wears away more easily than the harder cutting layer. However, single layer preforms are also known and have the advantage that they may be thermally stable.

In the type of drill bit to which the invention relates, the cutting elements are mounted on the bit body by being bonded, for example by brazing, to a carrier which may be in the form of a stud of tungsten carbide which is received and located in a socket in the bit body which may be formed, for example, from steel or from a tungsten carbide matrix.

Conventionally, the studs on which the cutting elements are mounted are secured within their respective sockets by brazing, press fitting or shrink fitting. While press fitting and shrink fitting are suitable for steel bit bodies where the sockets may be fairly accurately machined, difficulties arise in using such methods with a matrix body. In view of the difficulties in machining tungsten carbide matrix, the sockets are usually molded in the surface of the bit body at the same time as the bit body is formed. However, this means that the dimensions of the sockets cannot be accurately controlled according to the tolerances necessary for press fitting or shrink fitting, with the result that studs may be inadequately secured within the sockets or attempts to hammer the studs into an undersize socket may lead to cracking of the bit body.

Attempts have been made to overcome this problem by moulding the side walls of the sockets in a manner to give a textured surface so as to increase the permitted tolerances to give a satisfactory interference fit, but such methods have not proved entirely satisfactory. The problem has normally, therefore, been overcome as far as matrix bits are concerned by brazing the studs in the sockets, but it will be appreciated that this adds to the cost of manufacture of the bit.

The present invention sets out to provide an improved form of mounting for the carriers of preform cutting elements in a bit body.

SUMMARY OF THE INVENTION

According to the invention, there is provided a rotary drill bit for use in drilling or coring deep holes in subsurface formations, comprising a bit body having a shank for connection to a drill string, a plurality of cutting elements mounted at the surface of the bit body, and a channel in the bit body for supplying drilling fluid to the surface of the bit body, at least some of the cutting elements each being mounted on a carrier which is received in a socket in the bit body, there being provided within the socket and disposed around at least a portion of the periphery of the carrier resiliently compressible retaining means which are formed separately from the carrier and bit body and are resiliently compressed between the carrier and the wall of the socket so as frictionally to retain the carrier in the socket.

The use of resiliently compressible retaining means permits greater tolerances in the relative dimensions of the socket and carrier and the invention is thus particularly suitable for use with matrix body bits where the sockets are moulded.

Said retaining means preferably comprise an arcuate element extending around a portion of the periphery of the carrier. The arcuate element is also preferably preshaped to conform substantially to the portion of the periphery of the carrier which it engages. Although the arcuate element may extend around only a portion of the periphery of the carrier, it preferably extends around substantially the whole periphery of the carrier.

The arcuate element may be formed from metal which is corrugated to provide the resilience thereof. For example, the corrugations may extend substantially parallel to the central axis of the carrier.

Alternatively, the arcuate element may be formed from material which is inherently resiliently compressible so that said material substantially fills the space between the portion of the carrier around which it extends and the wall of the socket.

In a further alternative arrangement, the retaining means comprise a plurality of separate resiliently compressible elements disposed side-by-side around at least a portion of the periphery of the carrier.

In any of the above arrangements, the internal wall of the socket is preferably formed with a recess in which said retaining means are at least partly located. In the case where the retaining means extend around substantially the whole periphery of the carrier, said recess may comprise an annular groove extending around the whole periphery of wall of the socket.

Alternatively, or additionally, the carrier itself may be formed with a recess in which the retaining means are at least partly located, and particularly in the case where the retaining means extend around substantially the whole periphery of the carrier, the recess may be an annular groove which also extends around the whole periphery of the carrier.

DETAILED DESCRIPTION OF THE PREFERRED EMBODIMENTS

Figure 1:
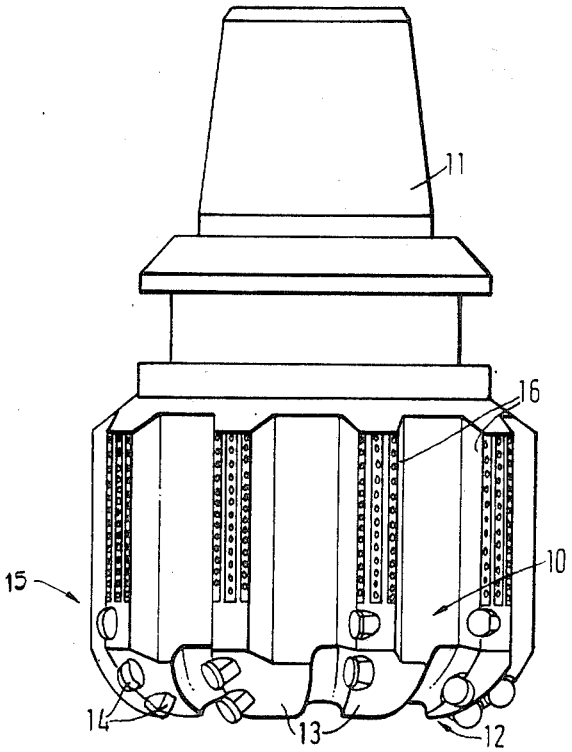
FIG. 1 is a side elevation of a typical drill bit in which cutting elements according to the invention may be used.
Figure 2:
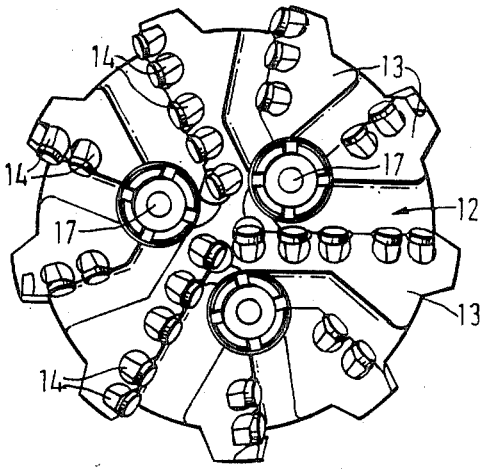
FIG. 2 is an end elevation of the drill bit shown in FIG. 1.

FIGS. 1 and 2 show a full bore drill bit of a kind to which the present invention is applicable.

The bit body 10 is typically formed of carbide matrix infiltrated with a binder alloy, and has a threaded shank 11 at one end for connection to the drill string.

The operative end face 12 of the bit body is formed with a number of blades 13 radiating from the central area of the bit and the blades carry cutting members 14 spaced apart along the length thereof.

The bit gauge section 15 includes kickers 16 which contact the walls of the bore hole to stabilise the bit in the bore hole. A central passage (not shown) in the bit body and shank delivers drilling fluid through nozzles 17 in the end face 12, in known manner.

It will be appreciated that this is only one example of the many possible variations of the type of bit to which the invention is applicable, including bits where the body is formed from steel.

Figure 3:
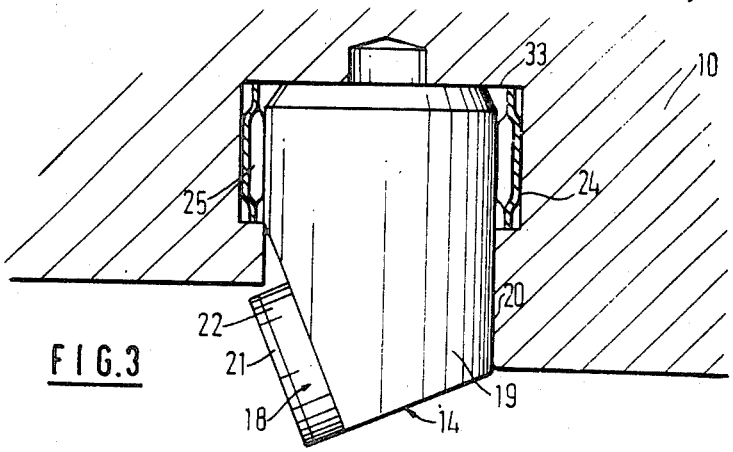
FIGS. 3 to 5 are diagrammatic sections through cutting elements mounted on studs in a drill bit body according to the invention.
Figure 4:
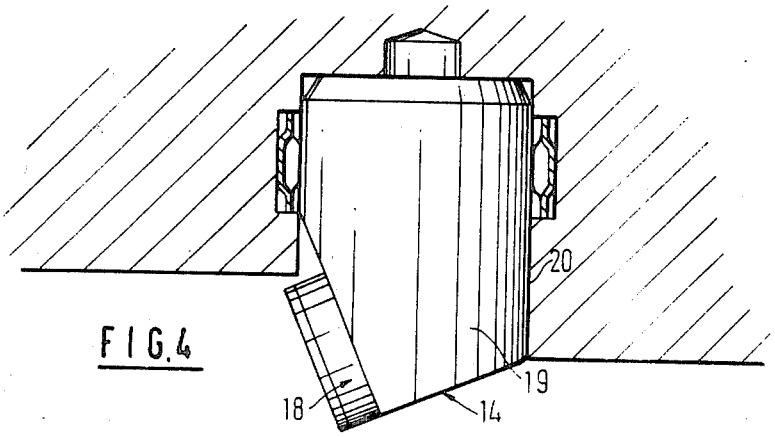
Figure 5:
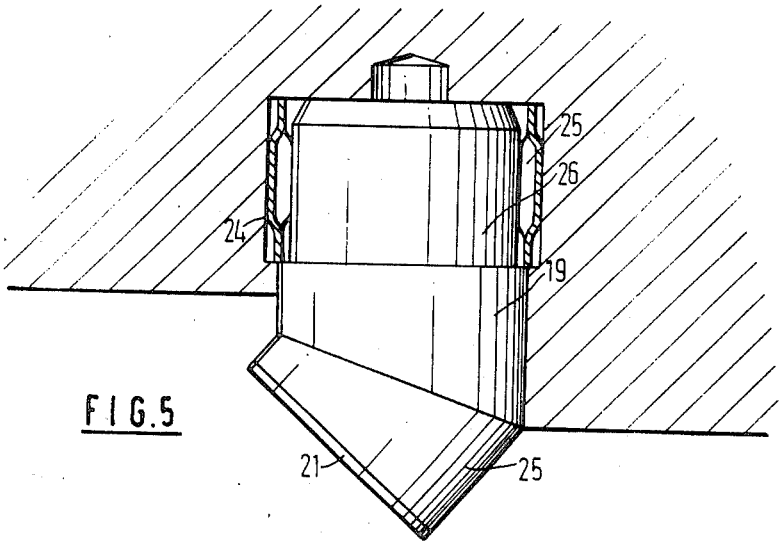

Referring to FIGS. 3 to 5, each cutting member 14 comprises a preform cutting element 18 mounted on a carrier 19 in the form of a stud which is located in a socket 20 in the bit body 10. Conventionally, each preform cutting element 18 is usually circular and comprises a thin facing layer 21 of polycrystalline diamond bonded to a backing layer 22 of tungsten carbide, both layers being of uniform thickness. The rear surface of the backing layer 22 is bonded, for example by brazing, to a suitably orientated surface on the stud 19 which may also be formed from tungsten carbide.

The stud 19 is conventionally of circular cross-section as is also the corresponding socket 20. As shown in FIG. 3, the socket 20 is formed adjacent the bottom wall 33 thereof with a peripheral annular groove 24 which extends axially but is spaced inwardly of the mouth of the socket. Located within the groove 24 is a corrugated metal tolerance ring 25 which is in the form of a collar substantially wholly encircling the stud 19.

The overall radial thickness of the ring 25, provided by the depth of the corrugations in the ring, is such that the ring is compressed radially between the adjacent surface of the stud 19 and the peripheral surface of the annular groove 24. The dimensions of the tolerance ring are so chosen as to accommodate tolerances in the dimensions of the socket and stud 19 to ensure that the stud 19 is retained by an interference fit in the socket.

In the alternative arrangement shown in FIG. 4, the annular groove 24 is spaced part-way between the mouth of the socket 20 and the bottom wall 23 thereof. Otherwise the arrangement is similar to that shown in FIG. 3.

In the arrangement of FIG. 5 the stud 19 is formed with a peripheral recess 26 at the end thereof remote from the cutting element 18 (which, in this instance, is generally wedge-shaped in cross-section). In this case the recess 26 serves to accommodate the tolerance ring 25. The tolerance ring may be wholly located within the recess 26, the socket being generally cylindrical, or the socket may also be formed, as shown, with an annular peripheral groove 24 which registers with the recess 26 on the stud 19 so that the tolerance ring projects partly into the recess on the stud and partly into the groove in the socket.

Although in the arrangement shown there is provided a complete tolerance ring which extends around the whole periphery of the stud, in some arrangements adequate fit may be obtained by providing an element which extends only partly around the periphery of the stud. Alternatively, the required resilient retaining means may be provided by a number of separate elements, such as axially extending roll pins, disposed side-by-side around at least part of the periphery of the stud.

The tolerance ring 25 may comprise a known form of split ring where the corrugations extend axially over the major part of the axial depth of the ring and are disposed parallel and side-by-side around the periphery of the ring. Such tolerance rings are conventionally used for securing elements to rotating shafts, but it has been discovered that they are also particularly suitable for use for the purposes according to the invention. When used in accordance with the present invention, such tolerance rings are acting in quite a different manner from their conventional use, since their normal primary function is to restrain relative rotation between the element and shaft with which they are used, whereas in the present invention there is little tendency for the stud to rotate about its central axis with respect to the socket, and the ring serves to restrain axial displacement of the stud from the socket.

Instead of a corrugated tolerance ring, the ring or other arcuate element may be formed from material which is inherently resiliently compressible so that it substantially fills the space between the stud 19 and the encircling wall of the socket.

In all arrangements according to the invention the dimensions of the retaining means, and the degree of its resilient compressibility, are such that the carriers or studs are adequately retained within their sockets solely by frictional engagement. As previously mentioned, one conventional method of retaining the studs in their sockets has been by brazing, and in such methods it is known, in some cases, to retain the carriers or studs in their sockets, prior to brazing, by the use of resilient elements, such as one or more roll pins. It will be appreciated, however, that in such cases the retaining function of the pins is purely temporary, and the relative dimensions and resilience characteristics of the components are not sufficient alone to ensure adequate retention of the carriers in the sockets during the use of the drill bit. Such known arrangements do not therefore fall within the scope of the present invention.

Although the invention is particularly applicable to matrix-bodied drill bits, for the reasons previously mentioned, there is of course no reason why the invention may not be used with advantage in drill bits formed of other materials, such as steel-bodied bits.

I claim:

1. A rotary drill bit, for use in drilling or coring holes in subsurface formations, comprising a bit body having a shank for connection to a drill string, a plurality of cutting elements mounted at the surface of the bit body, and a passage in the bit body for supplying drilling fluid to the surface of the bit body, at least some of the cutting elements each being mounted on a carrier which is received in a socket in the bit body, there being provided within the socket and disposed around at least a portion of the periphery of the carrier resiliently compressible retaining means which are formed separately from the carrier and bit body and are resiliently compressed between the carrier and the wall of the socket so as frictionally to retain the carrier in the socket, the retaining means comprising an arcuate element extending around a portion of the periphery of the carrier and corrugated to provide the resilience thereof, the corrugations extending substantially parallel to the central axis of the carrier.

2. A rotary drill bit, for use in drilling or coring holes in subsurface formations, comprising a bit body having a shank for connection to a drill string, a plurality of cutting elements mounted at the surface of the bit body, and a passage in the bit body for supplying drilling fluid to the surface of the bit body, at least some of the cutting elements each being mounted on a carrier which is received in a socket in the bit body, said socket having a recess therein, there being provided within the socket, at least partly in the recess, and disposed around at least a portion of the periphery of the carrier, resiliently compressible retaining means which are formed separately from the carrier and bit body and are resiliently compressed between the carrier and the wall of the socket so as frictionally to retain the carrier in the socket.

3. A drill bit according to claim 2, and in which the retaining means extend around substantially the whole periphery of the carrier, wherein said recess comprises an annular groove extending around the whole periphery of the wall of the socket.

4. A rotary drill bit, for use in drilling or coring holes in subsurface formations, comprising a bit body having a shank for connection to a drill string, a plurality of cutting elements mounted at the surface of the bit body, and a passage in the bit body for supplying drilling fluid to the surface of the bit body, at least some of the cutting elements each being mounted on a carrier having a recess, which carrier is received in a socket in the bit body, there being provided within the socket and disposed around at least a portion of the periphery of the carrier at least partly in the recess resiliently compressible retaining means which are formed separately from the carrier and bit body and are resiliently compressed between the carrier and the wall of the socket so as frictionally to retain the carrier in the socket.

5. A drill bit according to claim 4, wherein the recess in the carrier comprises an annular groove which extends around the whole periphery of the carrier.

6. A rotary drill bit, for use in drilling or coring holes in subsurface formations, comprising a bit body having a shank for connection to a drill string, a plurality of cutting elements mounted at the surface of the bit body, and a passage in the bit body for supplying drilling fluid to the surface of the bit body, at least some of the cutting elements each being mounted on a carrier which is received in a socket in the bit body, there being provided within the socket and disposed around at least a portion of the periphery of the carrier resiliently compressible retaining means which is formed separately from the carrier and bit body and is resiliently compressed between the carrier and the wall of the socket so as frictionally to retain the carrier in the socket, said retaining means comprising an arcuate metal element which extends around a portion of the periphery of the carrier and is corrugated to provide the resilience thereof.

7. A drill bit according to claim 6, wherein the arcuate element is pre-shaped to conform substantially to the portion of the periphery of the carrier which it engages.

8. A drill bit according to claim 6, wherein the arcuate element extends around only a portion of the periphery of the carrier.

9. A drill bit according to claim 6, wherein the arcuate element extends around substantially the whole periphery of the carrier.

* * * * *